United States Patent [19]

Taylor

[11] Patent Number: 4,884,353

[45] Date of Patent: Dec. 5, 1989

[54] FRONT LOADING SIGN ASSEMBLY

[76] Inventor: Warren A. Taylor, 116 South Chapel Ave. 'H', Alhambra, Calif. 91801

[21] Appl. No.: 98,628

[22] Filed: Sep. 21, 1987

[51] Int. Cl.[4] ..... G09F 7/02

[52] U.S. Cl. ..... 40/611; 40/642; 40/649

[58] Field of Search ..... 40/10 R, 16, 16.2, 16.4, 40/611, 5, 649, 642

[56] References Cited

U.S. PATENT DOCUMENTS

| | | | |
|---|---|---|---|
| 513,714 | 1/1894 | McArdle et al. . | |
| 1,843,883 | 2/1932 | Pogue | 40/611 |
| 1,864,656 | 6/1932 | Beaumont | 40/16 |
| 2,043,760 | 6/1936 | Marsh | 40/16.4 |
| 2,172,528 | 9/1939 | Auer | 250/67 |
| 2,353,469 | 7/1944 | Hopp | 40/16.2 |
| 2,362,273 | 11/1944 | Hopp | 40/16 |
| 4,268,984 | 5/1981 | Taylor | 40/154 |
| 4,444,319 | 4/1984 | Sharber | 211/50 |

FOREIGN PATENT DOCUMENTS

| | | | |
|---|---|---|---|
| 662052 | 4/1963 | Canada | 40/611 |
| 484483 | 2/1970 | Switzerland | 40/611 |
| 898255 | 6/1962 | United Kingdom | 40/611 |
| 1386420 | 3/1975 | United Kingdom | 40/10 R |

*Primary Examiner*—Kenneth J. Dorner
*Assistant Examiner*—J. Hakonaki
*Attorney, Agent, or Firm*—Kinney & Lange

[57] ABSTRACT

A front loading sign assembly includes a flexible, rectangular sign panel; and a rectangular sign frame lying generally in a first major plane and providing a front side to be viewed and a back wall integral with each of the four frame members. First and second facing parallel frame members of the frame are provided with overhanging lips. The rectangular flexible sign panel is installed by inserting it under these overhanging lips. Third and fourth frame members of the sign frame are provided with smooth sides in contact with sides of the sign panel when it is installed to prevent access to the panel and removal of the panel. A fulcrum extends outwardly from the back wall of the sign frame in parallel relationship to and midway between the first and second frame members. Manual pressure on the sign panel between the fulcrum and the first frame member causes the end of the sign panel adjacent the second frame member to spring clear of the sign frame assembly so that the panel can be removed.

7 Claims, 2 Drawing Sheets

FRONT LOADING SIGN ASSEMBLY

BACKGROUND OF THE INVENTION

1. Field of the Invention

This invention has relation to sign assemblies of the type in which a flexible sign panel is removably installed in a rectangular sign frame, held securely in that sign frame, and can then be easily removed from it without the aid of additional tools or equipment all from the front face of the sign frame.

2. Description of the Prior Art

Sign assemblies are known in which a flexible sign panel is installed from the front of a sign frame in such a manner that the end edges of the panel fit within undercut lips of the sign frame to firmly position the panel against removal or tampering; but where inward bowing of the sign panel exposes a hidden recess in the frame into which a tool can be inserted to pry the panel loose from the sign frame. Such a structure is disclosed in my U.S. Pat. No. 4,268,984 granted to Taylor in May of 1981.

Another patent which discloses structure whereby an end portion of a flexible sign panel can be made to extend away from its sign frame by depressing another portion of that panel is U.S. Pat. No. 2,043,760 granted to Marsh, granted in June of 1936.

In U.S. Pat. No. 513,714 granted to McArdle et al. in January of 1894, sheet metal sign frames are disclosed in which a raised stiffener or corrugation B extends across the center of the sign frame. In addition to stiffening the sheet metal frame, this corrugation B can also serve to firmly hold the sign panel or card firmly against the strips G to help to constantly maintain the card under tension.

U.S. Pat. No. 2,362,273 granted to Hopp in November of 1944 discloses a flexible sign panel supported under overhanging lips at opposite ends of the panel with a pair of longitudinally extending protrusions each adjacent to and parallel to one of the overhanging lips so that the sign panel is maintained in tension when so mounted. The sign panel is maintained in a bowed shape so that it can be easily removed simply by grasping opposite edges of it and withdrawing it, or by sliding it longitudinally out the end of the sign frame. A protective device consisting of a transparent body member 30 including a rigid main body portion 32 is fastened in place by screws so that the sign cannot be tampered with.

Located in a search of the prior art are the following patents which, while some of them have structures which may appear superficially similar to portions of the present invention, it is believed that they do not relate to the inventive concept of the present invention:

U.S. Pat. Nos. 2,851,804 granted to Roach in September of 1958; 2,181,976 granted to Lotz in December of 1939; 2,180,195 granted to Cavalero in November of 1939; 2,172,528 granted to Auer in September of 1939; 2,817,914 granted to Rosen in December of 1957; 1,787,308 granted to Furlong in December of 1930; 1,053,724 granted to Gardner et al. in February of 1913;and 641,287 granted to Goodwin in January of 1900.

What did not exist before the present invention was a front loading sign frame assembly in which a flexible sign panel could be installed in a multi-sided sign frame to lie perfectly flat in that frame and to appear to be completely inaccessible and unremovable; but which can be easily removed, substituted for, and/or reinstalled by the initiated over and over without the use of tools or apparatus other than the sign assembly itself.

SUMMARY OF THE INVENTION

A front loading sign assembly includes a multi-sided sign frame lying in a first major plane and having four frame members disposed in a multi-sided manner, a first and second of these frame members being disposed in parallel, facing relationship with respect to each other and each having an overhanging lip provided with a sign panel retaining surface extending inwardly toward the other parallel frame member. An apparently inaccessible, easily accessible, flexible sign panel of substantially congruent configuration with respect to the sign frame is provided, the panel being partially defined by spaced-apart end edges which are slightly farther apart than the distance between the innermost edges of the overhanging lips and the panel retaining surfaces.

The sign frame assembly is provided with a fulcrum adjacent the back side of the installed sign panel at a position intermediate between the first and second frame members. The size and configuration of the sign frame and sign panel and the flexibility of the sign panel are such that manual depression of the panel between the fulcrum and the first frame member will cause movement of the end edge portion of the panel retained by the overhanging lip of the second frame member until that end edge of the panel clears the overhanging lip of the second frame member and springs clear the second frame member.

DETAILED DESCRIPTION OF THE PREFERRED EMBODIMENTS

Figure 1:
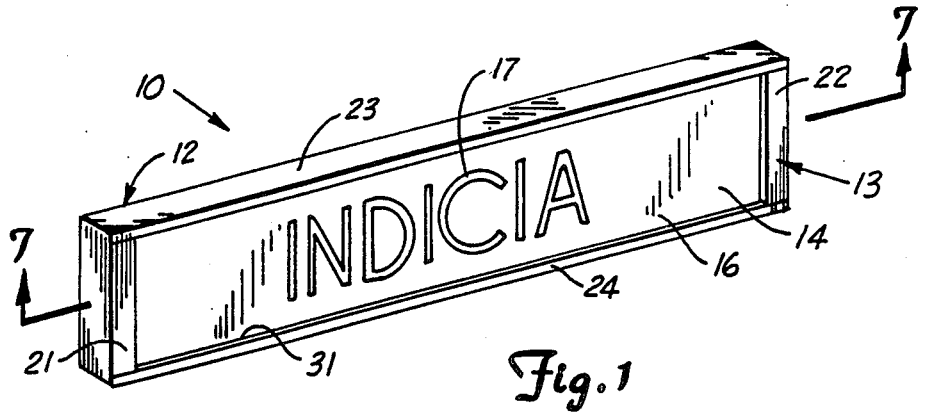
FIG. 1 is a perspective view of a front-loading sign assembly including an apparently inaccessible, easily accessible flexible sign panel installed on a multi-sided frame in accordance with the present invention.

A front loading sign assembly 10 defines generally a single major plane. It includes an apparently inaccessible, easily accessible, flexible sign panel 14; and a multi-sided sign frame 12 presenting a front side 13 to be viewed and back side 11.

Two forms of the invention are disclosed herein. In both forms, the multi-sided frame 12 is seen to disclose a transversely extending first frame member 21, a transversely extending second frame member 22, a longitudinally extending third frame member 23 and a longitudinally extending fourth frame member 24, all four disposed in a multi-sided manner, rectangular as shown. A back wall 25 of the sign frame 12 is integrally connected to all of the frame members. Screw holes 26 are provided in the back wall 25 for the purpose of supporting the sign assembly 10 through the instrumentality of screws 27 fastened into a vertical sign support wall 28.

As seen in FIG. 1, a front side 16 of the sign panel 14 can have indicia 17 thereon, or could be constituted as a display panel in a solid color, or simply as a cover panel to protect the interior of the frame 12 or of an area behind that frame from being viewed and/or from being tampered with. Throughout this specification, the panel 14 is referred to as a "sign panel", and this is to be considered synonymous with the term "closure panel" and the term "cover panel."

The flexible panel 14 can be of any relatively thin, stiff, resilient, flexible material. An aluminum and plastic laminate has been found suitable for the purpose. In addition to the front side 16, the sign panel 14 is defined by a back side 30, parallel side edges 31,31, a first end edge 32 and a second end edge 33 parallel with the first end edge. The third frame member 23 and the fourth frame member 24 of the multi-sided frame 12, as shown herein, are mutually parallel, extend integrally forwardly away from the back wall 25 and are separated from each other by a dimension which places each of them in adjacent, touching but non-binding relationship to one of the parallel side edges 31,31 of the flexible sign panel 14 when the sign panel is installed in the frame.

In a first form of the invention as seen in FIGS. 2–5, first frame member 21 and second frame member 22 of the sign frame 12 each are integral with and extend transversely between each of the third and fourth frame members and, in the form of the invention as shown in FIGS. 2, 3, 4 and 5, are permanently cemented or soldered to a front surface of the back wall 25 as at 36. The construction of each of the first and second frame members 21 and 22 is identical to the other, and each is integrally associated with the rest of the frame 12 so that they appear as mirror images of each other in the drawings.

Figure 5:
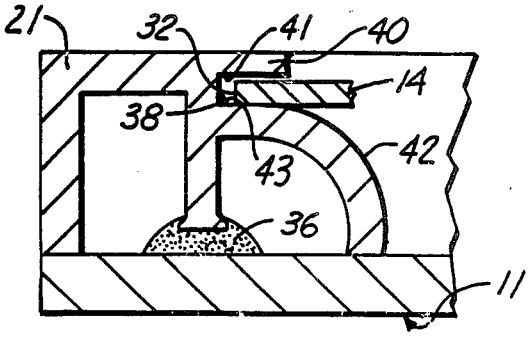
FIG. 5 is an enlarged fragmentary sectional view of a left-hand portion of the sign assembly as seen in FIG. 3.
Figure 6:
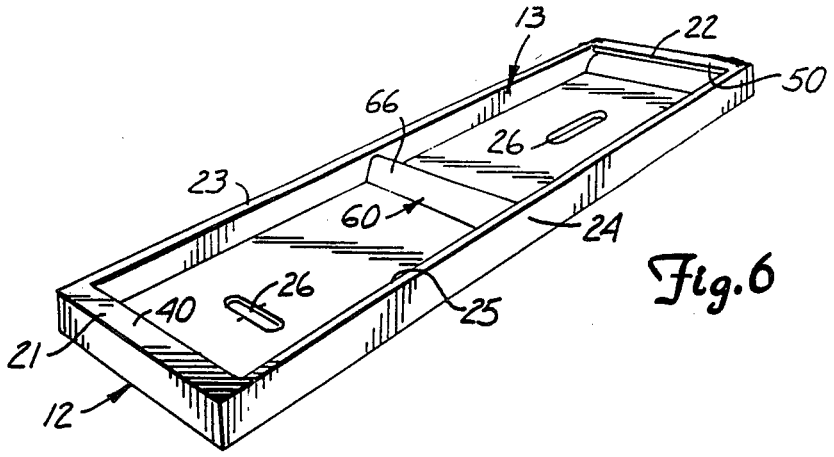
FIG. 6 is a perspective view of the multi-sided frame of FIG. 1 made according to a second form of the invention.

As best seen in FIG. 5, the first frame member 21 is so constituted as to provide a first sign panel confining surface 38 extending in normal relationship with respect to the major plane of the sign assembly 10, an overhanging lip 40 providing a second sign panel retaining surface 41, and an arcuate leg 42 providing a third sign panel engaging surface 43 at the intersection of the arcuate leg with the first sign panel confining surface.

The second frame member 22 is similarly provided with a first sign panel confining surface 48, an overhanging lip 50, a second sign panel retaining surface 51, an arcuate leg 52, and a third sign panel engaging surface 53.

Figure 3:
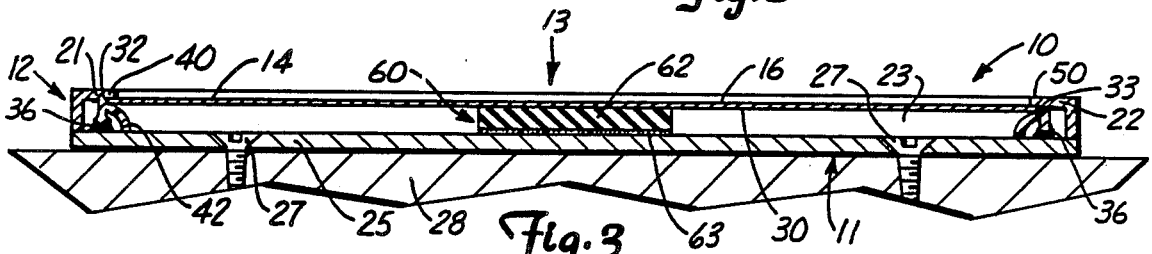
FIG. 3 is a horizontal sectional view taken on the line 3—3 in FIG. 2 but showing a flexible sign panel installed with respect to the multi-sided frame of FIG. 2 to a vertical wall.
Figure 7:
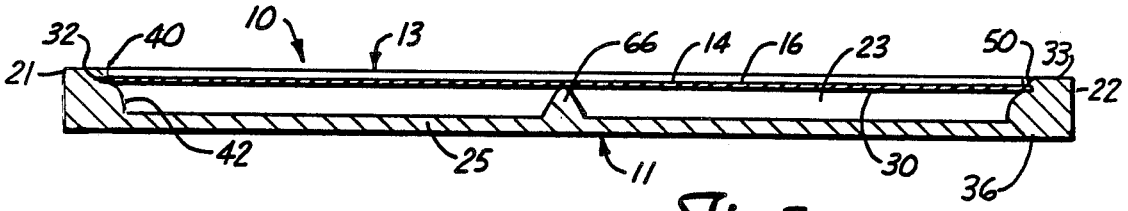
FIG. 7 is an enlarged horizontal sectional view of a front loading sign assembly made according to the second form, of the invention and taken on the line 7—7 in FIG. 1.

As best seen in FIGS. 3 and 7, the dimension of the flexible sign panel 14 from first end edge 32 to second end edge 33 is slightly greater than the distance between the innermost edges of the overhanging lips 40 and 50 and, therefore, of the second sign panel retaining surfaces 41 and 51.

In the second form of the invention as seen in FIGS. 6–9, the multi-sided sign frame 12 is disclosed as a one part injection molded plastic frame. Longitudinally extending third frame member 23 and fourth frame member 24 extend integrally upwardly from the back wall 25, and transversely extending first frame member 21 and second frame member 22 extend integrally from the back wall 25 and between the third and fourth frame members 23 and 24.

These transversely extending first and second frame members are provided with the same first sign panel confining surfaces 38 and 48, the same overhanging lips 40 and 50 providing the same second sign panel retaining surfaces 41 and 51, together with the same arcuate legs 42 and 52 as are provided in the transversely extending frame members 21 and 22 of the first form of the invention as disclosed in FIG. 5.

A distinguishing feature between these two forms of the invention is the nature of the fulcrum 60 forming part of the sign frame 12 and positioned adjacent the back side 30 of the installed flexible sign panel 14 and the back wall 25 of the frame 12, parallel to and intermediate the first and second frame members 21 and 22.

Figure 2:
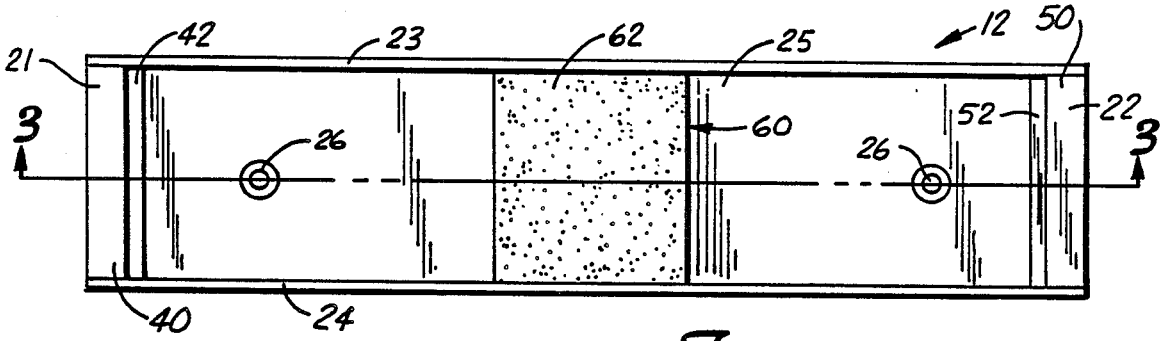
FIG. 2 is a front elevational view of the multi-sided frame of FIG. 1 made according to a first form of the invention.
Figure 4:
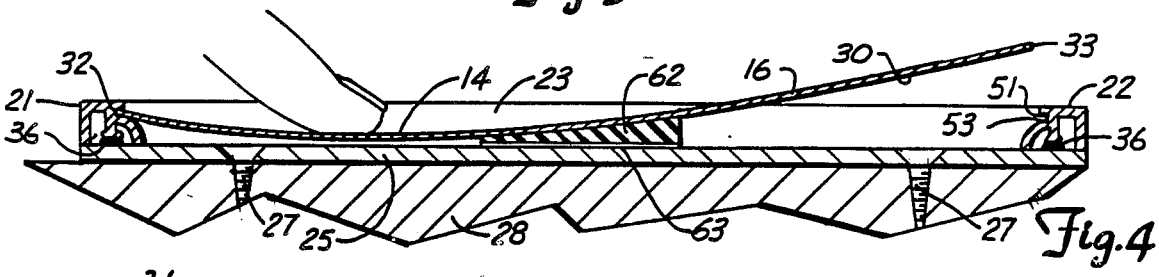
FIG. 4 is also a horizontal sectional view taken on the line in 3—3 in FIG. 2, but showing the flexible sign panel of FIG. 3 in the process of being assembled or from the multi-sided frame.

In the first form of the invention as seen in FIGS. 2, 3 and 4, this fulcrum 60 is constituted as a block of resilient closed cell plastic foam 62 cemented as at 63 to the back wall 25.

In the second form of the invention as seen in FIGS. 6, 7, 8 and 9, the fulcrum 60 consists of an elongated rigid triangular fulcrum 66 extending integrally forwardly away from the back wall 25.

In connection with the first form of the invention, FIGS. 1, 3 and 5 disclose a flexible sign panel 14 with indicia 17 displayed thereon, this panel being mounted in the multi-sided sign frame 12. As seen in FIGS. 2 and 5, when so installed, the first end edge 32 and the second end edge 33 of panel 14 are not as far from each other as are the first sign panel confining surface 38 of first frame member 21 and the first sign panel confining surface 48 of second frame member 22. At the same time, also as seen in FIGS. 2 and 5, these first and second end edges 32 and 33 of the panel 14 are farther from each other than are the inner ends of the overhanging lips 40 and 50 of the transversely extending first and second frame members 21 and 22 of the multi-sided sign frame 12. Left undisturbed, then, the sign panel 14 will not and cannot "escape" from the sign frame 12; and the means of removing the panel 14 from the frame 12 is not apparent from any viewing of the front loading sign assembly 10.

In order to remove the panel 14 from the frame 12, the effective distance between first end edge 32 and second end edge 33 of the panel 14 must be reduced. To do this most effectively, a finger of the person removing panel 14 is used to slide the panel to the left as seen in FIGS. 3, 4 and 5, until the first end edge 32 of the panel is in confining contact with the first sign panel confining surface 38. Then the finger is used to depress the relatively thin, stiff, resilient, flexible sign panel 14 between the first end edge 32 thereof and the fulcrum formed by the resilient closed cell plastic foam block 62. The resultant curving of the panel 14 is seen in FIG. 4. It effectively moves the second end edge 33 closer to the first end edge 32 until the point is reached where edge 33 moves into clearing relation with respect to the second sign panel retaining surface 51 at the very end of the overhanging lip 50 of the second frame member 22. At that point, the resilience of the panel 14, acting under the influence of the fulcrum 62, will cause the panel to take the position as seen to the right in FIG. 4. The panel 14 can then be grasped in the other hand, slid clear of the overhanging lip 40, and removed from the sign frame 12.

To reinstall this panel, or to insert a new panel of the same size, configuration and similar resiliency, the first end edge 32 of the panel to be reinserted will be slid between the second sign panel retaining surface 41 and the third sign panel engaging surface 43 of the first frame member 21, bringing the first end edge 32 of the panel 14 into contact with the first sign panel confining surface 38. The portion of the sign panel between fulcrum 62 and the first frame member 21 will then be depressed to cause the panel to take position as seen in FIG. 4; and, holding this part of the panel depressed, the far right end of the panel will be depressed until it takes position below the overhanging lip 50 of the second frame member 22. Then the down pressure on the left end of the panel will be carefully released to allow the second end edge 33 of the panel to move to position under the overhanging lip 50.

As will be discussed later in connection with FIG. 9, the panel 14 in the first form of the invention, as in the second form, can be reinserted by simply bowing it upwardly and sliding each of the end edges of the panel underneath one of the overhanging lips 40 and 50. This method of installation is preferable where a panel is to be replaced in the presence of others who do not need to know the procedures for removing panels.

The panel 14 can be installed or reinserted simply by inserting its first end edge 32 up against the first sign panel confining surface 38 in either form of the invention and then placing it flat in contact with the fulcrum 60 to have the second end edge 33 lying in contact with the outer surface of the overhanging lip 50 of the second frame member 22. The person installing the sign can then push down on the front side 16 of the panel 14 between the fulcrum 60 and the second frame member 22, and the length of panel 14 will be temporarily automatically shortened sufficiently so that its second end edge 33 will snap into place under the overhanging lip 50. This method of installation tends to cause somewhat more wear on the second end edge 33 of the panel than other methods, but it, too, is effective to allow the panel to be replaced in the presence of others who do not need to know the procedures for removing panels.

It has been found in dealing with fulcrums such as the block of resilient closed cell plastic foam of fulcrum 62 that when one edge portion of the fulcrum is depressed as seen in FIG. 4, the overall volume of the block does not change appreciably. This results in the portion opposite the depressed portion expanding in outward dimension, thus to initially bow the right-hand portion of the panel 14 upwardly to, in this way, assist in reducing the distance between the end edges 32 and 33 of the panel 14 when the far right-hand end of the panel is bowed down to reinsert the panel, for example.

Figure 8:
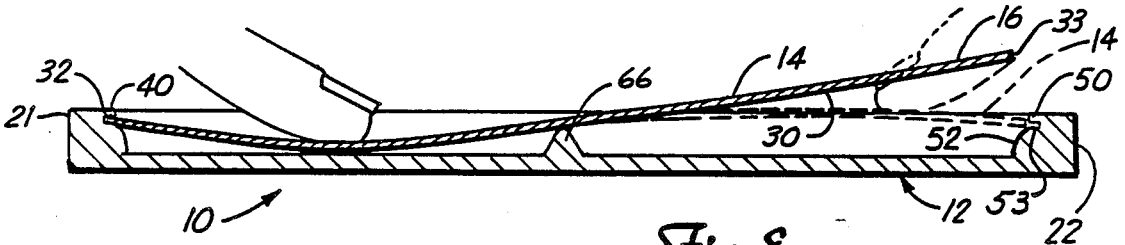
FIG. 8 is a horizontal sectional view also taken on the line 7—7 in FIG. 1 but showing a flexible sign panel in the process of being assembled and in the process of being disassembled from the frame assembly of FIG. 7.

Turning now to the second form of the invention, the flexible sign panel 14 is seen installed and at rest in FIGS. 1 and 7. To remove the panel, it is moved as far as possible to the left, for example, as seen in FIG. 8. The portion of the panel between the first frame member 21 and the solid fulcrum 66 is depressed, thus shortening the distance between the first and second end edges 32 and 33 sufficiently so that the end of the panel to the right as seen in FIG. 8 moves into clearing relationship with respect to the overhanging lip 50. The sign panel will take on a double bend causing the distance between the second end edges 32 and 33 to be shortened. The position of the end edge 33 just after it moves clear of lip 50 is seen in dotted lines in FIG. 8. The sign panel 14 will then take the position as seen in full lines in that figure and can be removed.

The panel may be reinstalled or a new panel may be inserted by the technique described above in connection with the first form of the invention and by reference to the dotted lines in FIG. 8. Holding the left half of the panel as seen in full lines in FIG. 8, the right half is depressed until the second end edge 33 takes position below the overhanging, lip 50 as seen in dotted lines in that figure. The pressure on the left half is then carefully released to cause the second end edge 33 to move beneath the overhanging lip 50. All pressure is then released, and the panel will take position as seen in FIG. 5.

These actions, when performed rapidly and smoothly, will allow the release and/or installation of the panel 14 but will not necessarily indicate to anyone but the most careful observer just how this release or installation was accomplished.

Figure 9:
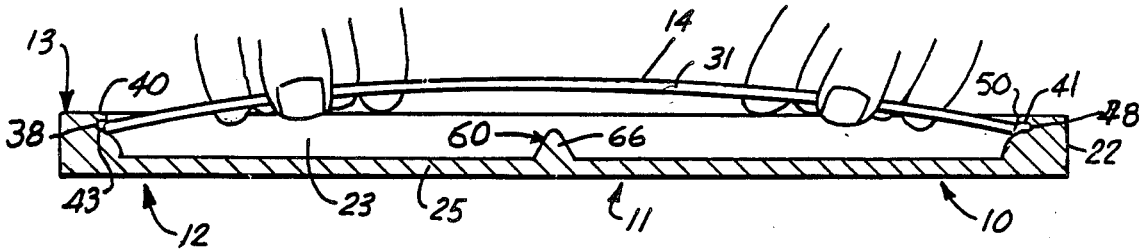
FIG. 9 is yet another horizontal sectional view taken on line 7—7 in FIG. 1 but disclosing an alternate method of inserting a flexible sign panel from the front side of the frame assembly preparatory to taking its position as seen in FIGS. 1, 5 and 7.

By bowing the end edges of the panel 14 downwardly to position approximately as seen in FIG. 9, and then carefully releasing them to have positions under the overhanging lips 40 and 50, the panel can be reinstalled without giving even the most astute observer an indication as to how the panel can be removed.

The solid fulcrum 66 has the possible advantage that the action in removing the panel 14 is more positive than when using fulcrum 62; but the resilient fulcrum 62 has the advantage that the angle of the bend in the panel 14 necessary to achieve release of the panel is much smoother and less likely to cause the panel to take on a permanent deformation or set after many, many usages.

For clarity of expression and understanding, the installation and removal of flexible sign panel 14 has been stated in terms of the "first end edge 32 of the panel 14" being inserted under the overhanging lip 40 or being slid over against the first sign panel confining surface 38, and then the "second end edge 33 of the panel 14" being released from or moved under the overhanging lip 50 of the transversely extending second frame member 22. In point of fact, the installation and removal of the flexible sign panel 14 can be accomplished equally well when the second end edge 33 of the panel is moved to the right as seen in the drawings, and the first end edge 32 thereof is the one which is released from and/or installed under the overhanging lip 40 of the transversely extending first frame member 21.

Although the present invention has been described with reference to preferred embodiments, workers skilled in the art will recognize that changes may be made in form and detail without departing from the spirit and scope of the invention.

What is claimed is:

1. A front loading sign assembly having an apparently inaccessible, easily accessible sign panel, said sign assembly including:

(a) a multi-sided sign frame lying generally in a major plane and providing a front side to be viewed and a back side, said frame including at least four frame members disposed in a multi-sided manner, a first and a second of said frame members being disposed in parallel, facing relation to each other and each having:

(1) a first sign panel confining surface effective in a plane normal to the first plane, (2) an overhanging lip provided with a second sign panel retaining surface extending inwardly from the first panel confining surface on the viewing side of the sign frame assembly and effectively lying in parallel relation to the first plane, and a third sign panel engaging surface extending inwardly from the first sign panel engaging surface in spaced, parallel relation to said second panel retaining surface;

(b) a flexible sign panel of substantially congruent configuration with respect to the frame assembly, said panel being partially defined by spaced-apart, mutually parallel, first and second end edges and spaced-apart, mutually parallel, third and fourth side edges, said first and second end edges being nominally slightly farther from each other than the distance between the innermost edges of the second retaining surfaces, said sign panel being insertable from the front side of the frame to be installed to lie flat and to engage the third sign panel engaging surfaces, to be confined between the first panel confining surfaces and to be retained in the frame by the second panel retaining surfaces;

(c) said frame being provided with a fulcrum adjacent to the back side of the installed sign panel at an intermediate position between the first and second frame members;

(d) the size and configuration of the frame and the flexibility of the panel being such that manual depression of the installed panel between the fulcrum and the first end edge of the panel will cause a concave bend in the depressed part of the panel and a convex bend in that part of the panel on the opposite side of the fulcrum from the first end edge of the panel resulting in a reduction of the distance between the first and second end edge portions of the panel and resulting in movement of the second end edge portion of the panel away from the first panel confining surface of the second frame member until it clears the second panel retaining surface and springs clear of the second frame member;

(e) wherein a third and fourth frame member are each provided with a sign panel protecting surface in adjacent, parallel, close relationship to one of the third and fourth panels side edges in position to prevent access to the undersides of said side edges of the panel when the panel is in its installed position.

2. The sign assembly of claim 1 wherein:

(f) means is provided to cooperate with the frame to limit the distance the panel can be depressed after one end of the panel springs clear of one of the frame members.

3. The sign assembly of claim 1 wherein:

(f) the distance between the first sign panel confining surface of one of the first and second frame members and the innermost edge of the retaining surface of the other of the sign frame members is less than the distance between said first and second spaced-apart panel end edges when said panel is in its nominal, installed, flat condition.

4. The sign assembly of claim 1 wherein:

(f) the sign frame includes a back wall fixedly supported with respect to the sign frame members; and (g) the fulcrum includes a longitudinally extending block of resilient plastic foam supported on said back wall.

5. The sign assembly of claim 4 wherein:

(k) the fulcrum extends transversely of the sign frame and is in contact with a back side of the side panel when the panel is installed in the frame.

6. The sign assembly of claim 1 wherein:

(f) the fulcrum includes a rigid bar fixedly mounted with respect to said side frame members.

7. The sign assembly of claim 6 wherein:

(g) the fulcrum extends transversely of the side frame and is in contact with a back side of the sign panel when the panel is installed in the frame.

* * * * *